US011529547B1

(12) United States Patent
Stearns et al.

(10) Patent No.: US 11,529,547 B1
(45) Date of Patent: Dec. 20, 2022

(54) CLIMBING EXERCISE APPARATUS

(71) Applicants: Kenneth W Stearns, Houston, TX (US); Joseph D. Maresh, West Linn, OR (US)

(72) Inventors: Kenneth W Stearns, Houston, TX (US); Joseph D. Maresh, West Linn, OR (US)

( * ) Notice: Subject to any disclaimer, the term of this patent is extended or adjusted under 35 U.S.C. 154(b) by 29 days.

(21) Appl. No.: 16/740,392

(22) Filed: Jan. 10, 2020

Related U.S. Application Data

(63) Continuation-in-part of application No. 16/246,665, filed on Jan. 14, 2019, now Pat. No. 10,987,539, which is a continuation of application No. 15/361,368, filed on Nov. 25, 2016, now Pat. No. 10,179,260.

(60) Provisional application No. 62/918,014, filed on Jan. 10, 2019.

(51) Int. Cl.
*A63B 22/04* (2006.01)
*A63B 21/00* (2006.01)

(52) U.S. Cl.
CPC ..... *A63B 22/04* (2013.01); *A63B 21/4034* (2015.10); *A63B 21/4035* (2015.10); *A63B 21/4045* (2015.10)

(58) Field of Classification Search
CPC . A63B 22/04; A63B 21/4034; A63B 21/4035; A63B 21/4045
See application file for complete search history.

(56) References Cited

U.S. PATENT DOCUMENTS 3,381,958 A * 5/1968 Gulland ..... A63B 22/205 482/37
4,958,830 A * 9/1990 Huggins ..... A61H 1/0259 482/52
5,000,441 A * 3/1991 Wang ..... A63B 22/0002 482/53
5,007,631 A * 4/1991 Wang ..... A63B 23/03583 482/52
5,037,088 A * 8/1991 Bernstein ..... A63B 23/12 482/8
5,040,785 A * 8/1991 Charnitski ..... A63B 22/205 482/52
D323,008 S * 1/1992 Wang ..... D21/670
5,169,361 A * 12/1992 Hsu ..... A63B 22/205 482/53
5,199,932 A * 4/1993 Liao ..... A63B 22/001 482/37
5,222,927 A * 6/1993 Chang ..... A63B 22/205 482/53
5,295,927 A * 3/1994 Easley ..... A63B 21/015 482/52
D355,228 S * 2/1995 Hung ..... A63B 22/205 D21/670
5,492,515 A * 2/1996 Charnitski ..... A63B 22/205 482/37

(Continued)

*Primary Examiner* — Andrew S Lo
(74) *Attorney, Agent, or Firm* — Nick A Nichols, Jr.

(57) ABSTRACT

A climbing exercise apparatus having homolateral and contralateral modes of operation may include a frame supporting generally vertically oriented reciprocating members. The reciprocating members may include foot supports fixedly secured at the lower distal ends thereof, and handlebars secured proximate the upper distal ends of the reciprocating members. The reciprocating members path of motion may include vertical and lateral components.

15 Claims, 14 Drawing Sheets

(56) References Cited

U.S. PATENT DOCUMENTS

| | | | | |
|---|---|---|---|---|
| 5,928,115 | A * | 7/1999 | Arroyo, Jr. | A63B 22/0605 482/62 |
| 9,205,297 | B2 * | 12/2015 | Kaehler | A63B 21/0428 |
| D759,169 | S * | 6/2016 | Humberto Mercenari Uribe | A63B 23/03583 D21/670 |
| 10,179,260 | B1 * | 1/2019 | Stearns | A63B 21/4034 |
| 2013/0210587 | A1 * | 8/2013 | Shank | A63B 25/08 482/77 |
| 2015/0343259 | A1 * | 12/2015 | Mercenari Uribe | A63B 23/03583 482/52 |
| 2016/0361590 | A1 * | 12/2016 | Miller | A63B 22/0056 |
| 2020/0038706 | A1 * | 2/2020 | Liu | A63B 22/0056 |

* cited by examiner

CLIMBING EXERCISE APPARATUS

CROSS-REFERENCE TO RELATED APPLICATION

This application claims priority to and the benefit of the filing date of U.S. Provisional Application Ser. No. 62/918,014, filed Jan. 10, 2019, and is a continuation-in-part of U.S. patent application Ser. No. 16/246,665, filed Jan. 14, 2019, which is a continuation of U.S. patent application Ser. No. 15/361,368, filed Nov. 25, 2016, now U.S. Pat. No. 10,179,260, which applications are herein incorporated by reference in their entirety.

BACKGROUND

The present invention relates to climbing exercise apparatus where the exercise paths are substantially vertical and parallel to each other.

Climbing exercise machines permit a user to simulate climbing activities where two coordinated body movements are generally possible. A first motion may be referred to as homolateral movement where an asymmetrical movement of the upper limb and the lower limb on the same side occurs, and a second motion referred to as contralateral movement where diagonal movement of an upper limb with the opposite lower limb occurs. The first motion of homolateral movement or straight climbing is more closely correlated with martial arts where martial arts typically employ homolateral movements, whereas the second motion of asymmetrical or cross climbing action is more closely correlated with oppositional exercises such as swimming and walking. In homolateral motion the body halves do not cooperate but move separately, and in contralateral motion both sides of the brain function at the same time in a coordinated manner.

SUMMARY

A climbing exercise apparatus having homolateral and contralateral modes of operation may include a frame supporting generally vertically oriented reciprocating members. The reciprocating members may include foot supports fixedly secured at the lower distal ends thereof, and handlebars secured proximate the upper distal ends of the reciprocating members. The reciprocating members path of motion may include vertical and lateral components.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION

Figure 1:
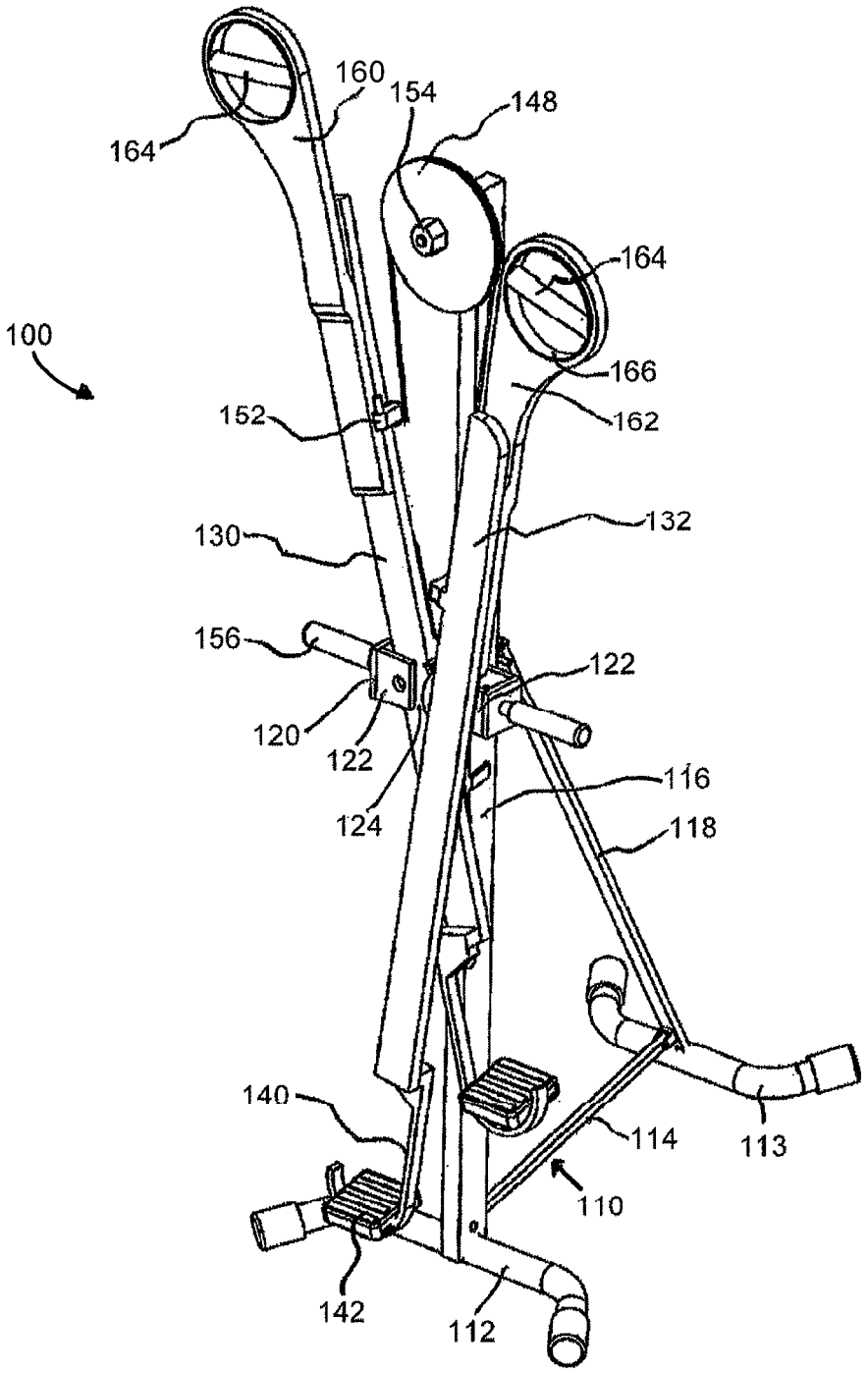
FIG. 1 is a perspective view of a climbing exercise apparatus.
Figure 2:
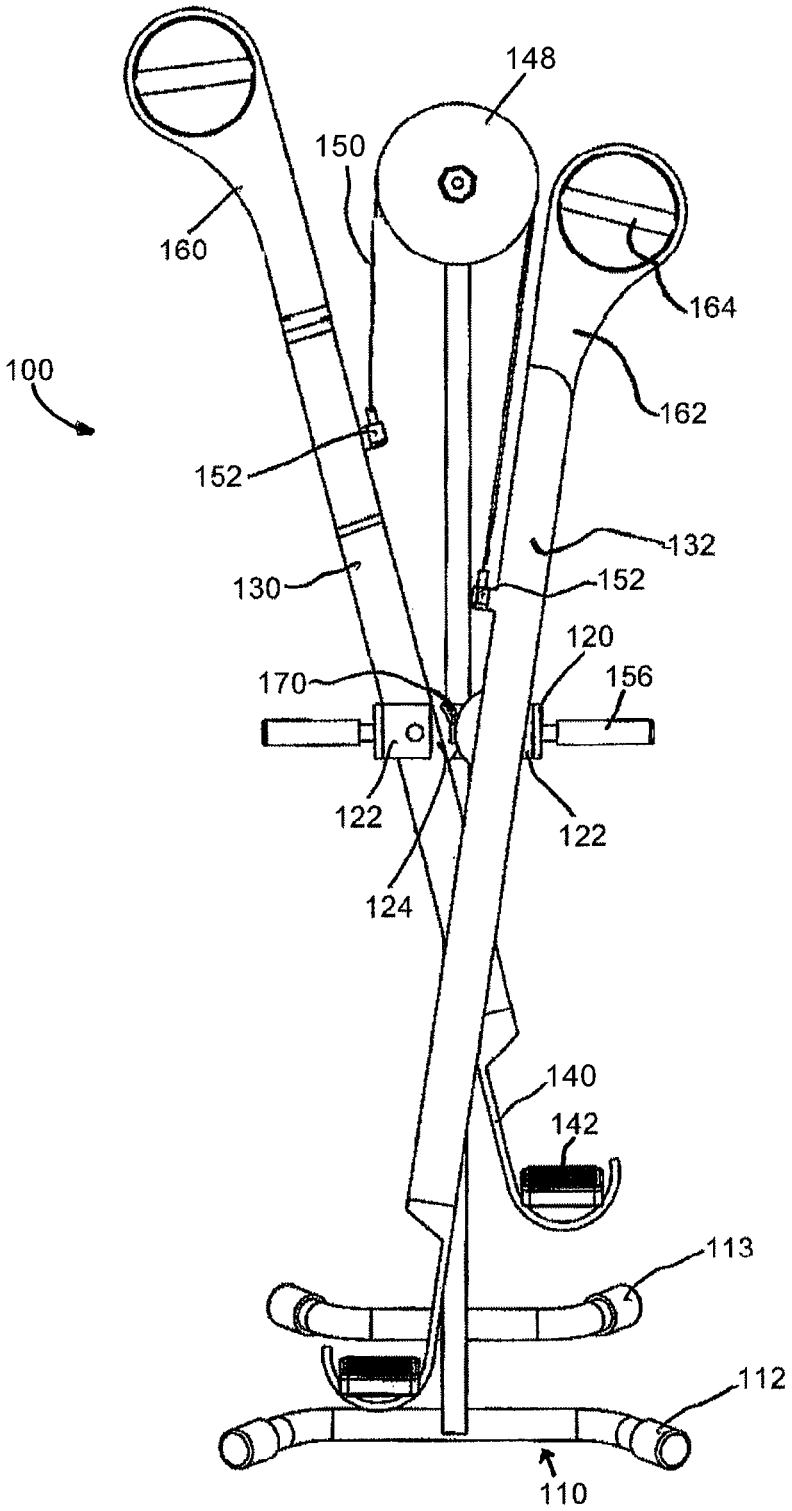
FIG. 2 is a front view of the climbing exercise apparatus shown in FIG. 1.
Figure 3:
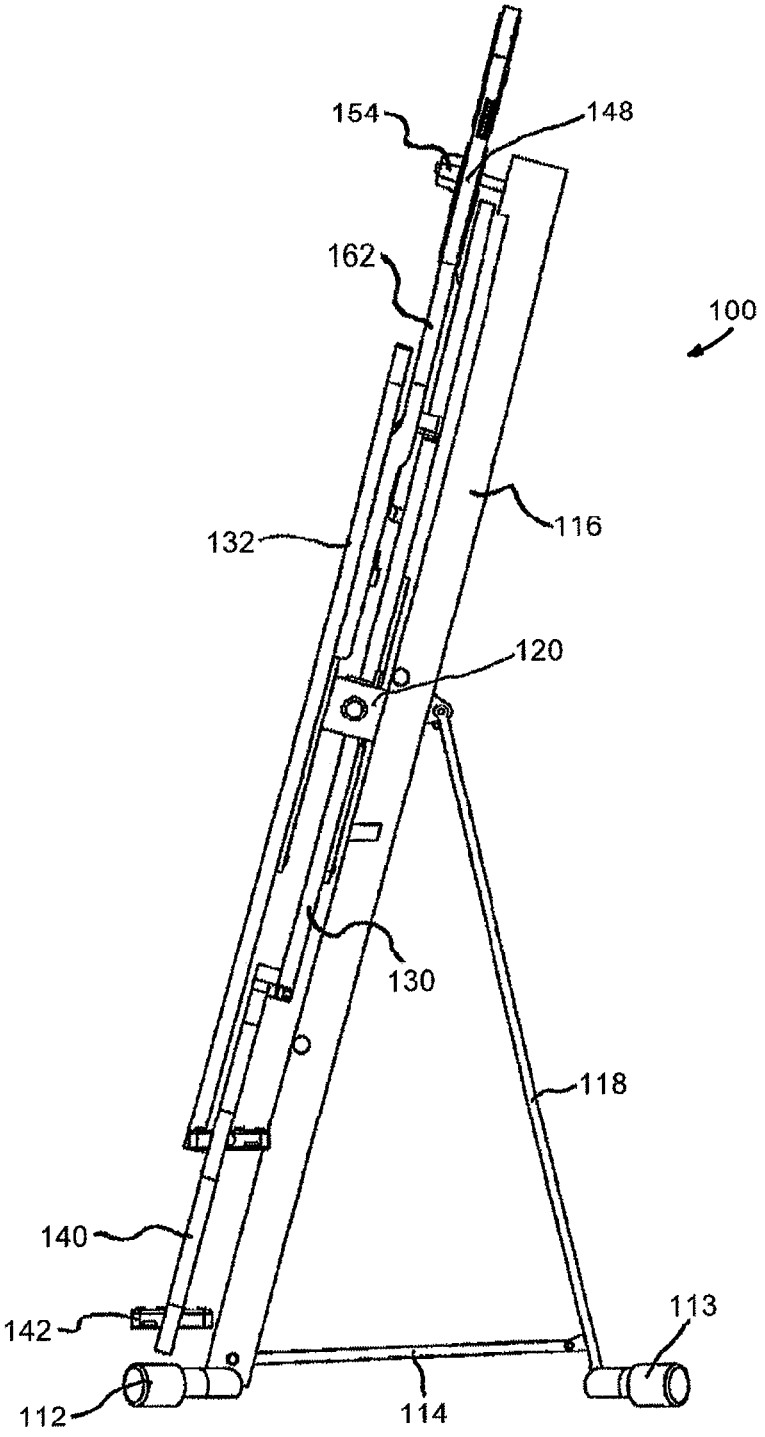
FIG. 3 is a side view of the climbing exercise apparatus shown in FIG. 1.
Figure 4:
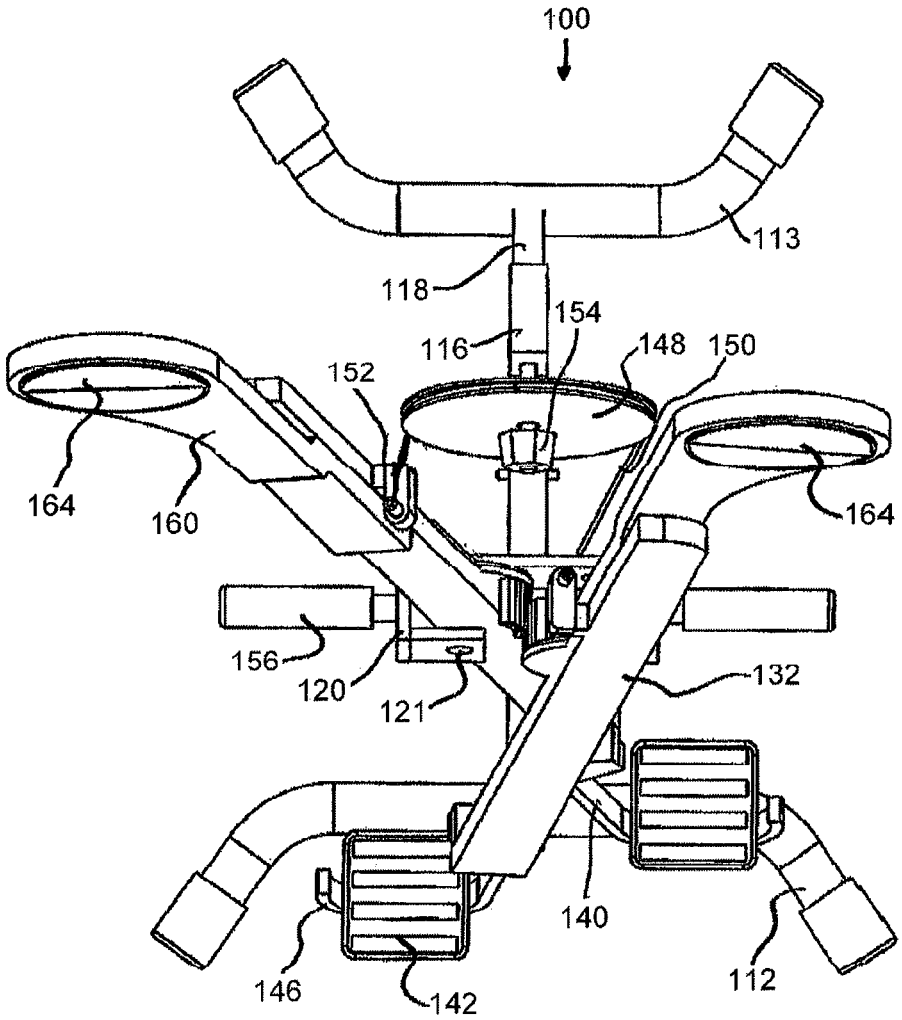
FIG. 4 is top perspective view of the climbing exercise apparatus shown in FIG. 1.
Figure 5:
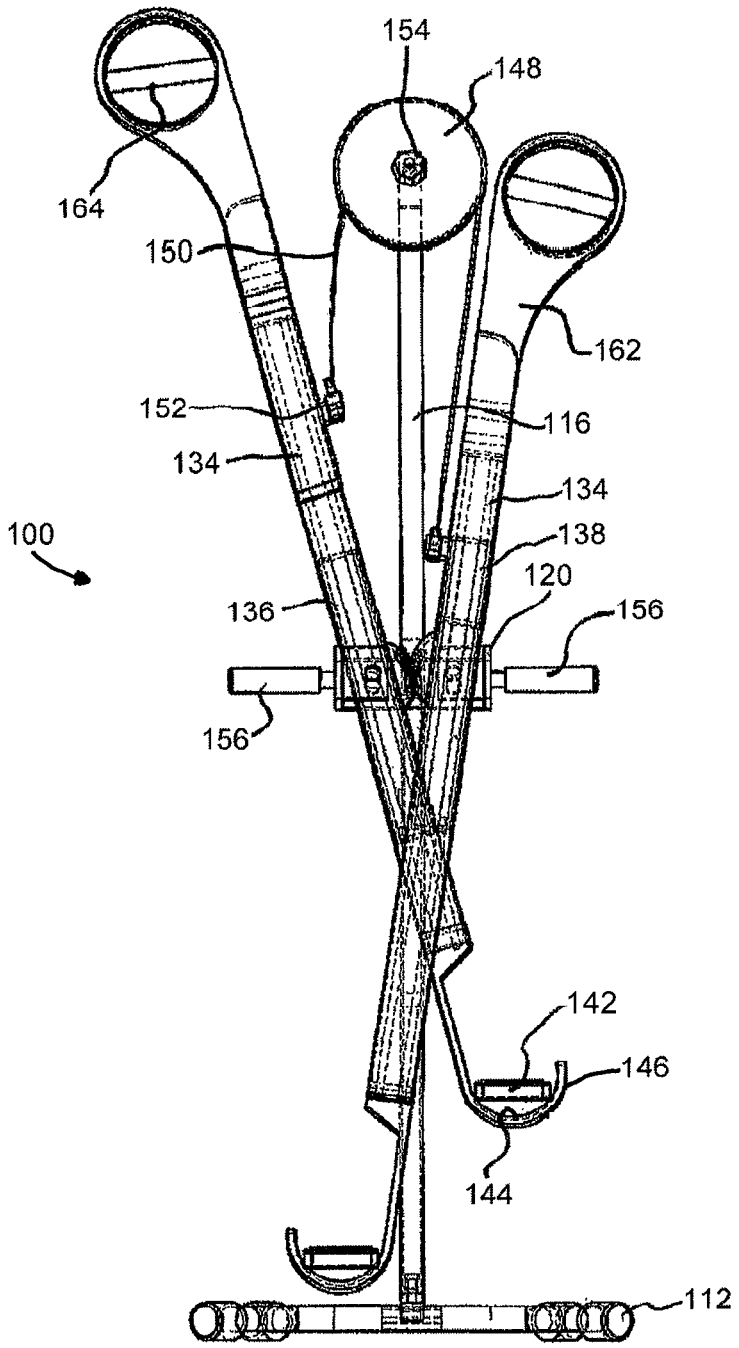
FIG. 5 is a front view of the climbing exercise apparatus shown in FIG. 1 with hidden lines shown.

Referring first to FIG. 1, a climbing exercise apparatus is generally identified by the reference numeral 100. The climbing exercise apparatus 100 may include a frame 110 including spaced apart base members 112, 113 interconnected by a cross connecting member 114. A generally vertically extending stanchion 116 may be fixedly secured to the frame 110. A generally angularly extending brace member 118 may have a lower end secured to the base member 113 and an upper end connected to the stanchion 116.

A support bracket 120 may be fixedly secured to the stanchion 116. The bracket 120 may be substantially rectangular in shape and extend transverse to the longitudinal axis of the stanchion 116. The front face of the bracket 120 may be defined by two flange members 122 extending toward each other and defining a gap 124 between the spaced apart facing distal ends of the flange members 122.

Figure 6:
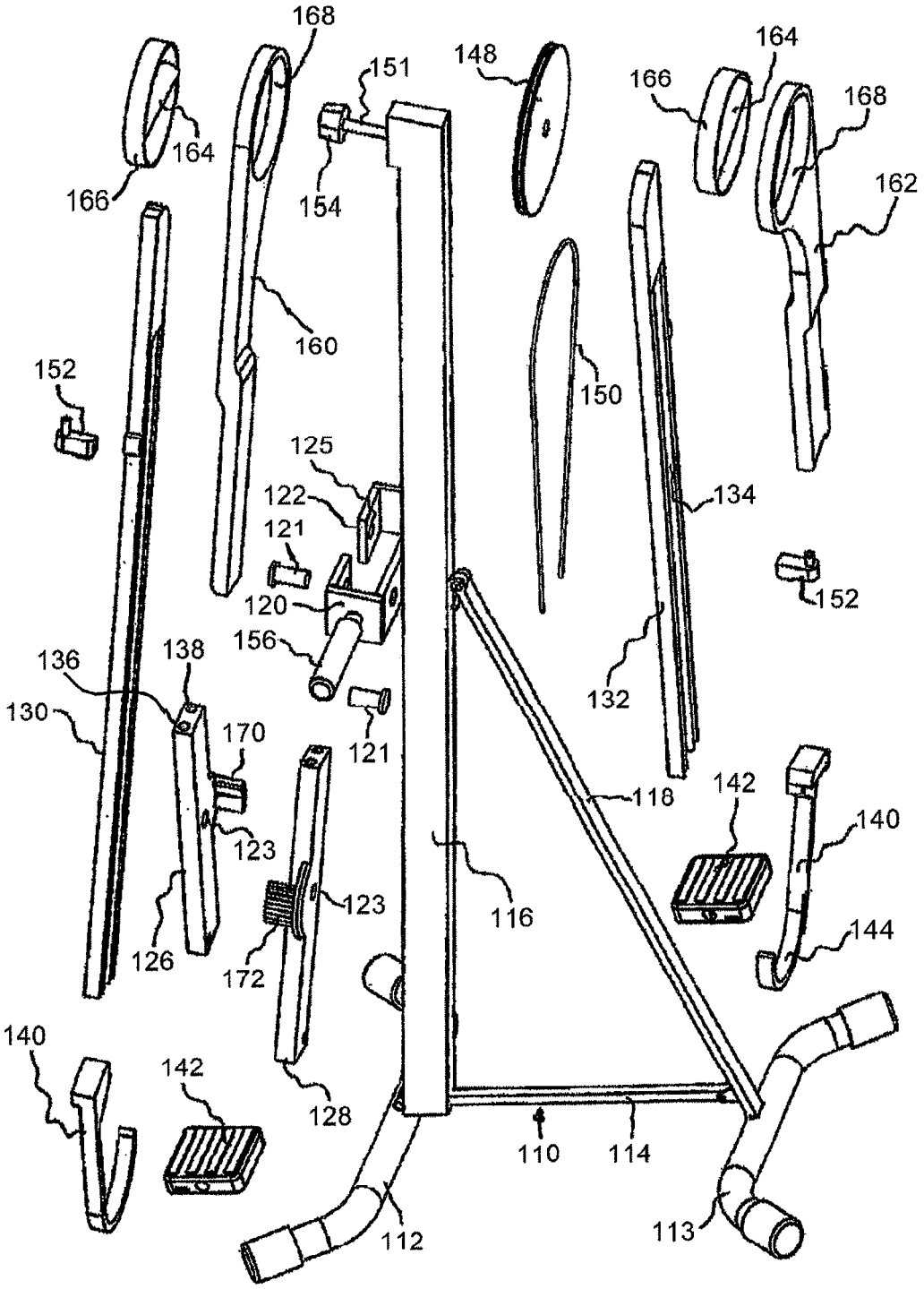
FIG. 6 is an exploded perspective view of the climbing exercise apparatus shown in FIG. 1.

Referring now to FIG. 6, pivot blocks 126 and 128 may be pivotally secured to the bracket 120 by pins 121 which extend through holes 123 in the pivot blocks 126, 128 and holes 125 in the bracket 120. Longitudinal members 130 and 132 may include a pair of longitudinal shafts 134 which may be received in longitudinal races 136 and 138 of the pivot blocks 126, 128, respectively. The longitudinal members 130, 132 may be linearly constrained by the longitudinal races 136, 138 as they are reciprocated relative to the pivot blocks 126, 128. Other types of linear bearing may be employed to linearly constrain the longitudinal members 130, 132 along the pivot blocks 126, 128, such as but without limitation, rollers which may capture at least a portion of the longitudinal members 130, 132 in a linear manner. Foot support members 140 may be fixedly secured to the lower distal ends of the longitudinal members 130, 132. Foot pedals 142 may be rigidly or rotatably secured to the foot support members 140. In the instance where the foot pedals 142 may be right-to-left self-leveling, the ends of the pedal axle 144 may extend into the foot support race 146.

The longitudinal members 130, 132 may be generally vertically oriented and may be linearly reciprocated by a user a distance which corresponds to the maximum desired stepping height of the user. A pulley 148 may be rotatably secured to the stanchion 116 about a shaft 151. A cable 150 and the like may be utilized to provide reciprocal or oppositional dependent action of the longitudinal members 130, 132. The cable 150 may be routed over the pulley 148 and the opposite distal ends thereof secured to cable anchors 152 which are fixedly secured to respective longitudinal members 130, 132. A tension knob 154 may be optionally provided to adjust rotational resistance of the pulley 148. In such instance, friction disks may be interposed between the stanchion 116 and the pulley 148. Fixed handles 156 may be optionally provided.

Arm members 160 and 162 may be secured to longitudinal members 130, 132, respectively, with unillustrated bolts or jam members and the like. The arm members 160, 162 may be adjusted up/down to accommodate different user heights. Hand grips 164 may be rotatably secured to the arm members 160, 162. The hand grips 164 may be secured to a circular race 166 which is operatively engaged and concentric with a race 168 formed proximate the upper distal ends of the arm members 130, 132. Alternate handlebars may be provided, such as but without limitation, hand grips rigidly secured to the arm members 160, 162.

The pivot blocks 126, 128 may be fixed or pivotally connected to the bracket 120 at an angle relative to the longitudinal axis of the stanchion 116 so that movement of the longitudinal members 130, 132 along the pivot blocks 126, 128 includes a vertical component and a lateral component. The pivot blocks 126, 128 may optionally include sector gears 170 and 172, respectively, cooperatively engaged for oppositional pivoting of the pivot blocks 1126, 128. That is, the hands and feet of the user will move in opposing directions in a cross crawl or contralateral motion. The path of motion is generally diagonal which consequently introduces a lateral motion component to the path and feet of the user.

Figure 7:
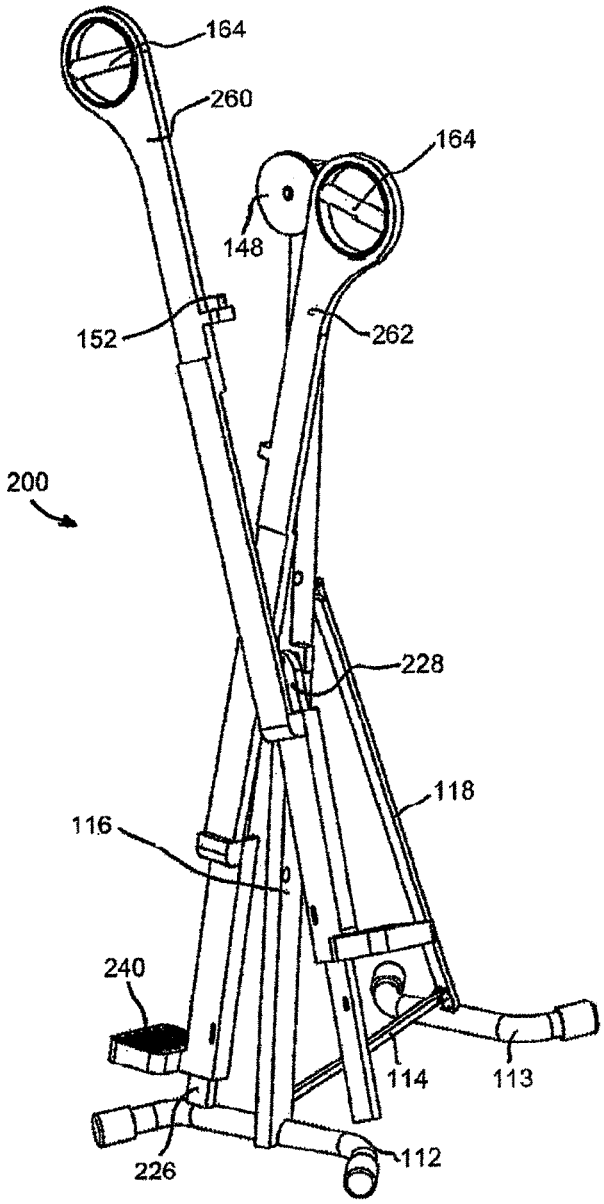
FIG. 7 is a perspective view of a second embodiment of a climbing exercise apparatus.
Figure 8:
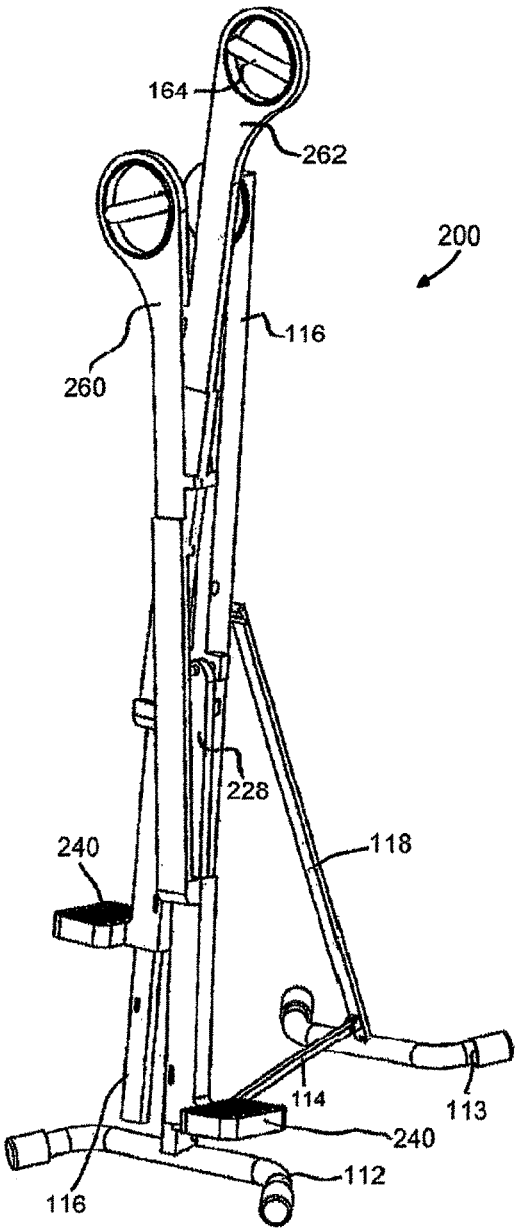
FIG. 8 is a perspective view of the climbing exercise apparatus shown in FIG. 7 depicting the reciprocating members in a second position.
Figure 9:
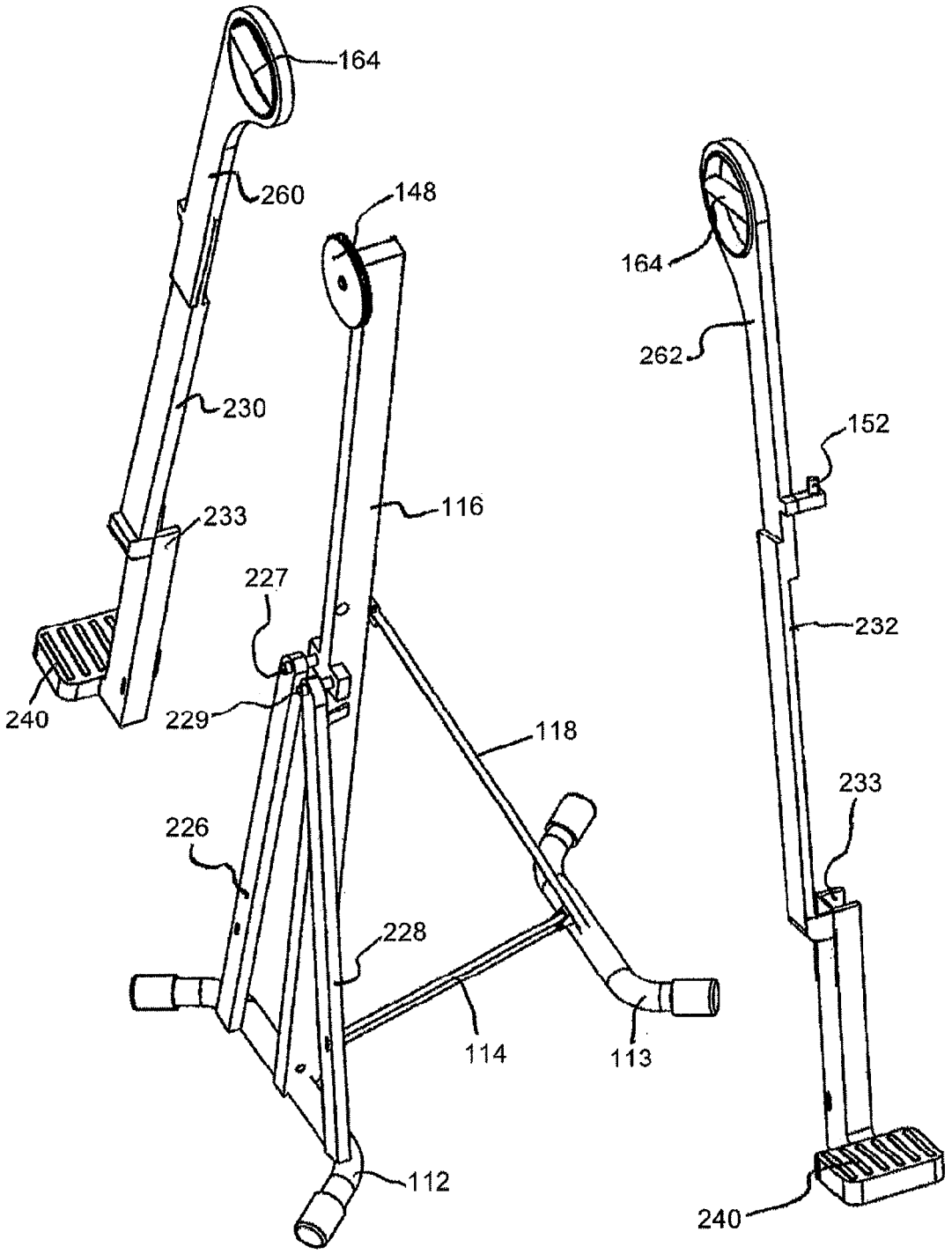
FIG. 9 is an exploded perspective view of the climbing exercise apparatus shown in FIG. 7.

Referring now to FIGS. 7-9, a second embodiment of a climbing exercise apparatus is generally identified by the reference numeral 200. As noted by the common use of reference numerals, the climbing exercise apparatus 200 is similar to the climbing exercise apparatus 100. Pivot blocks 226 and 228 may be pivotally secured to the stanchion 116 at pivot shafts 227 and 229, respectively. Longitudinal members 230 and 232 may include a lower portion defining a channel 233 configured to slide along the pivot blocks 266, 228. The upper portion of the longitudinal members 230, 232 define arm members 260 and 262, respectively. Foot members 240 may be secured proximate the lower ends of the channel 233 of the longitudinal members 230, 232. The pivot blocks 226, 228 may be constructed of UHMW, and in other instances ball bearing or cylindrical rollers may be utilized between the pivot blocks 226, 228 and the channels 233. Hand grips 164 may be secured to the longitudinal members 230, 232 in the manner described above. A pulley 148 may be rotatably secured to the stanchion 116 about a shaft 151. A flexible member or cable (not shown in FIGS. 7-9) may be utilized to provide reciprocal or oppositional dependent motion of the longitudinal members 130, 132. The cable may be routed over the pulley 148 and the opposite distal ends thereof secured to cable anchors 152 which are fixedly secured to respective longitudinal members 130, 132.

While the longitudinal members 230, 232 may reciprocate along the pivot blocks 226, 228, the longitudinal members 230, 232 may move independent of one anther laterally in response to the force applied by the user's feet, as illustrated in FIGS. 7 and 8.

Figure 10:
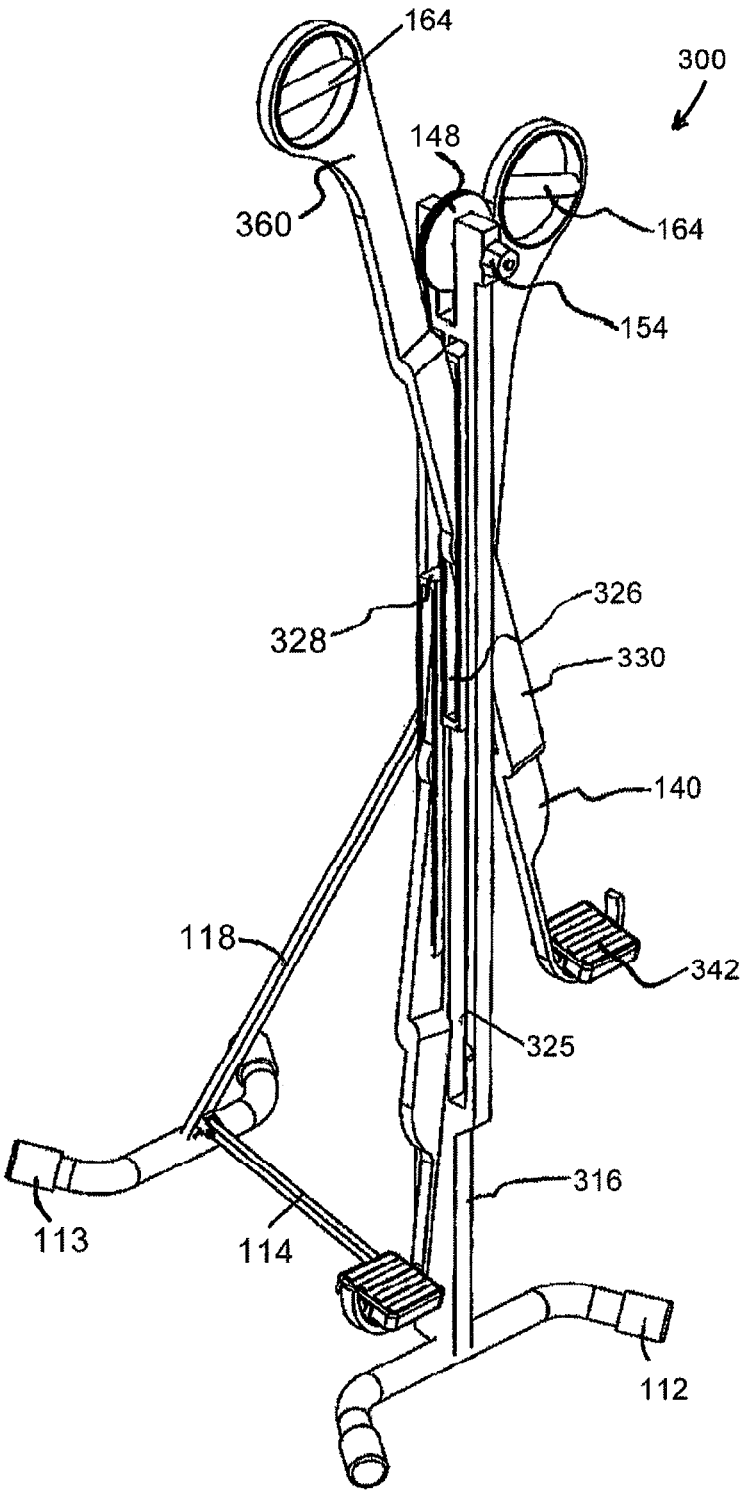
FIG. 10 is perspective view of a third embodiment of a climbing exercise apparatus.
Figure 11:
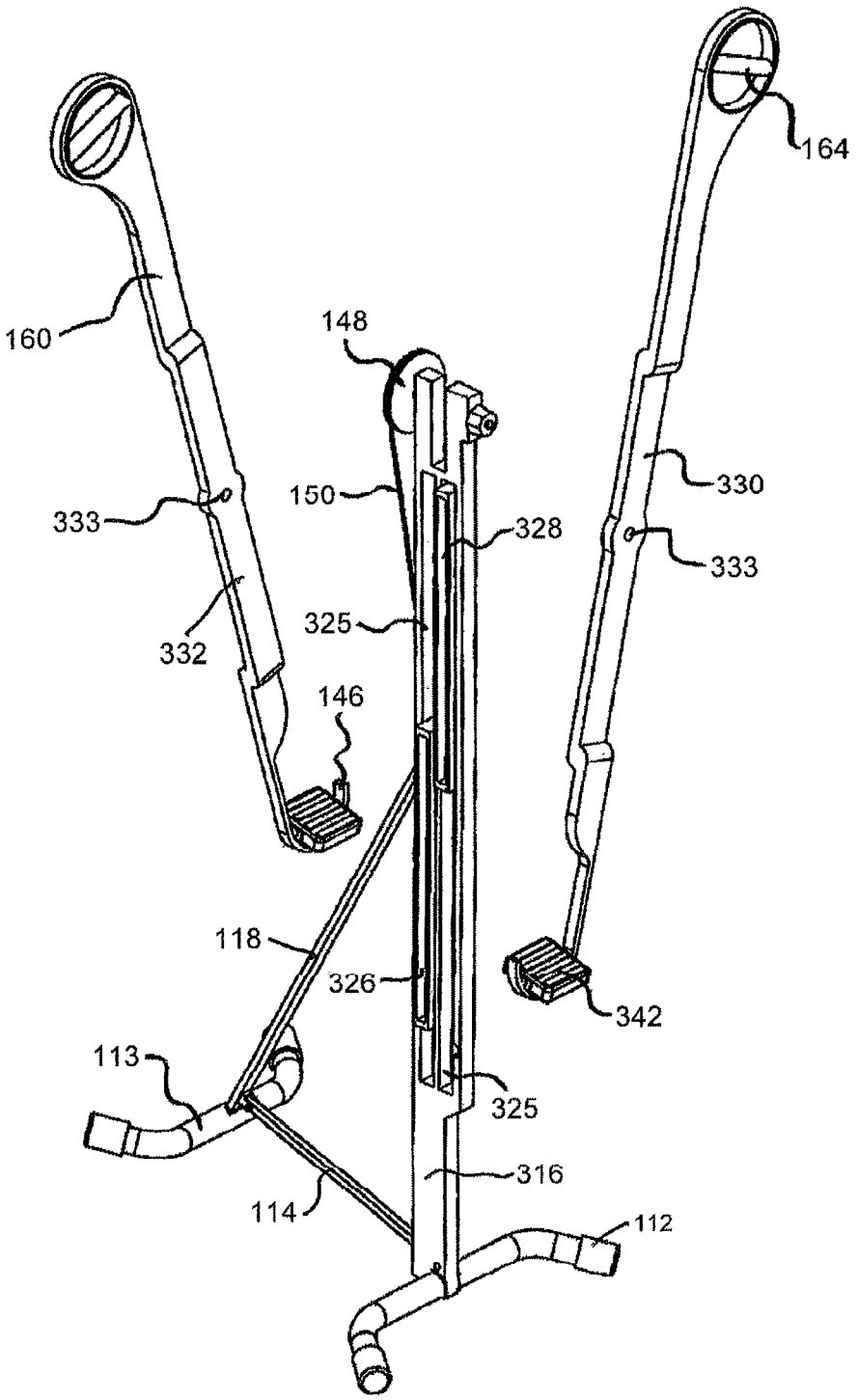
FIG. 11 is an exploded perspective view of the climbing exercise apparatus shown in FIG. 10.
Figure 12:
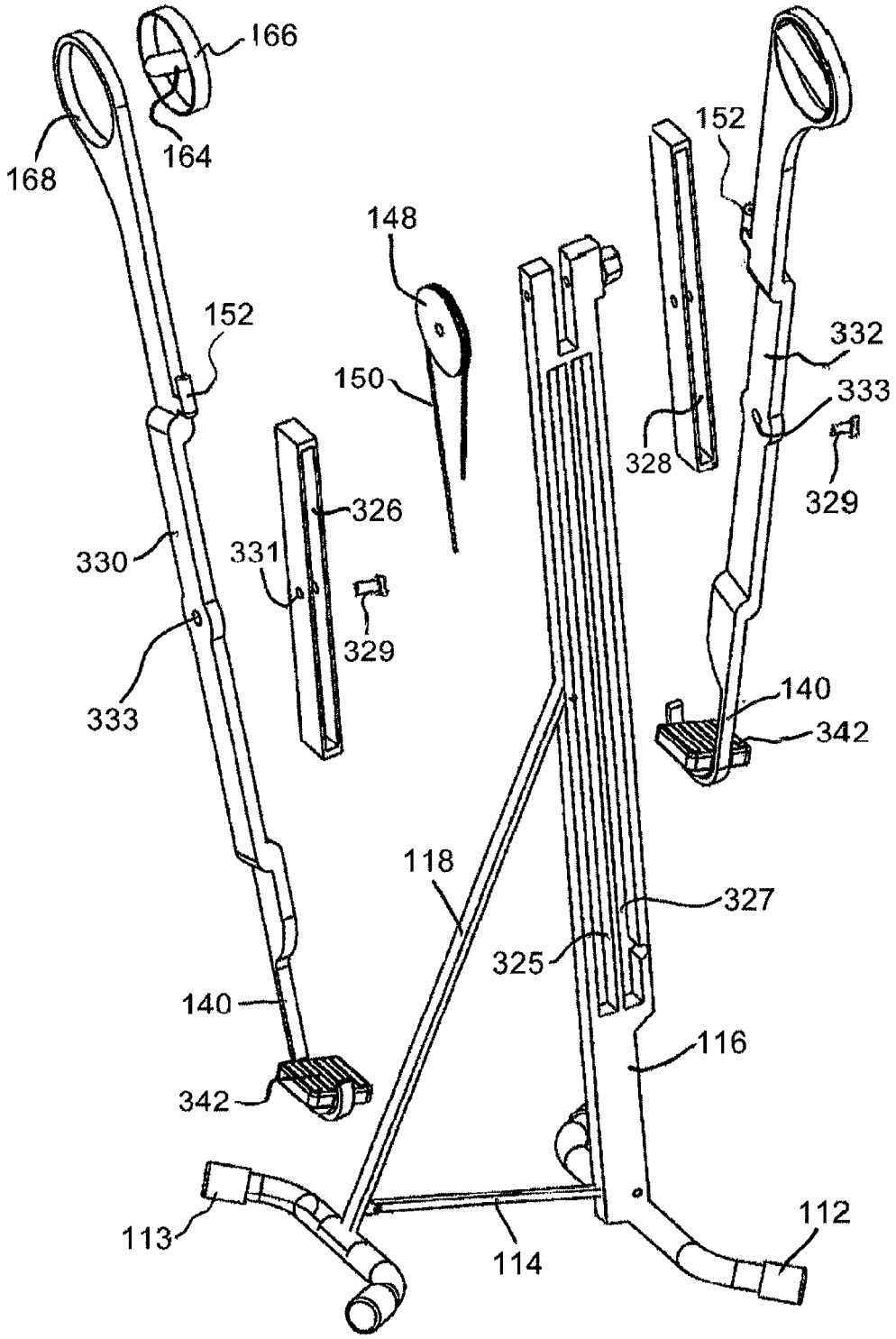
FIG. 12 is a second exploded perspective view of the climbing exercise apparatus shown in FIG. 10.

Referring now to FIGS. 10 and 12, a third embodiment of a climbing exercise apparatus is generally identified by the reference numeral 300. As noted by the common use of reference numerals, the climbing exercise apparatus 300 is similar to the climbing exercise apparatus 100. The climbing exercise apparatus 300 may include a frame 110 including spaced apart base members 112, 113 interconnected by a cross connecting member 114. A generally vertically extending stanchion 316 may be fixedly secured to the frame 110. A generally angularly extending brace member 118 may have a lower end secured to the base member 113 and an upper end connected to the stanchion 316.

The stanchion 316 may include generally vertically extending front and rear longitudinal slots 325 and 327. Pivot blocks 326 and 328 may be linearly constrained to move along the front and rear longitudinal slots 325, 327, respectively. Longitudinal members 330 and 332 may be rotatably secured to pivot blocks 326, 328, respectively, at pivot pins 329. The longitudinal members 330, 332 may extend through the pivot blocks 326, 328 at an angle, respectively. The through holes 331 of the pivot blocks 326, 328 may be aligned with through holes 333 of the longitudinal members 330, 332 and the pivot pins 329 inserted therethrough. The end of the pivot pins 329 may be flush with the sidewalls of the pivot blocks 326, 328 so as not to interfere with the reciprocal movement of the pivot blocks 326, 328 along the front and rear longitudinal slots 325, 327.

Foot pedals 342 may be connected to the lower distal ends of the longitudinal members 330, 332 and hand grips 164 may be connected proximate the upper distal ends of the longitudinal members 330, 332, described in greater detail hereinabove. A pulley 148 may be rotatably secured proximate the upper distal end of the stanchion 316. A flexible member or cable 150 may be utilized to provide reciprocal or oppositional dependent action of the longitudinal members 130, 132. The cable 150 may be routed over the pulley 148 and the opposite distal ends thereof secured to cable anchors 152 which are fixedly secured to respective longitudinal members 330, 332.

Figure 13:
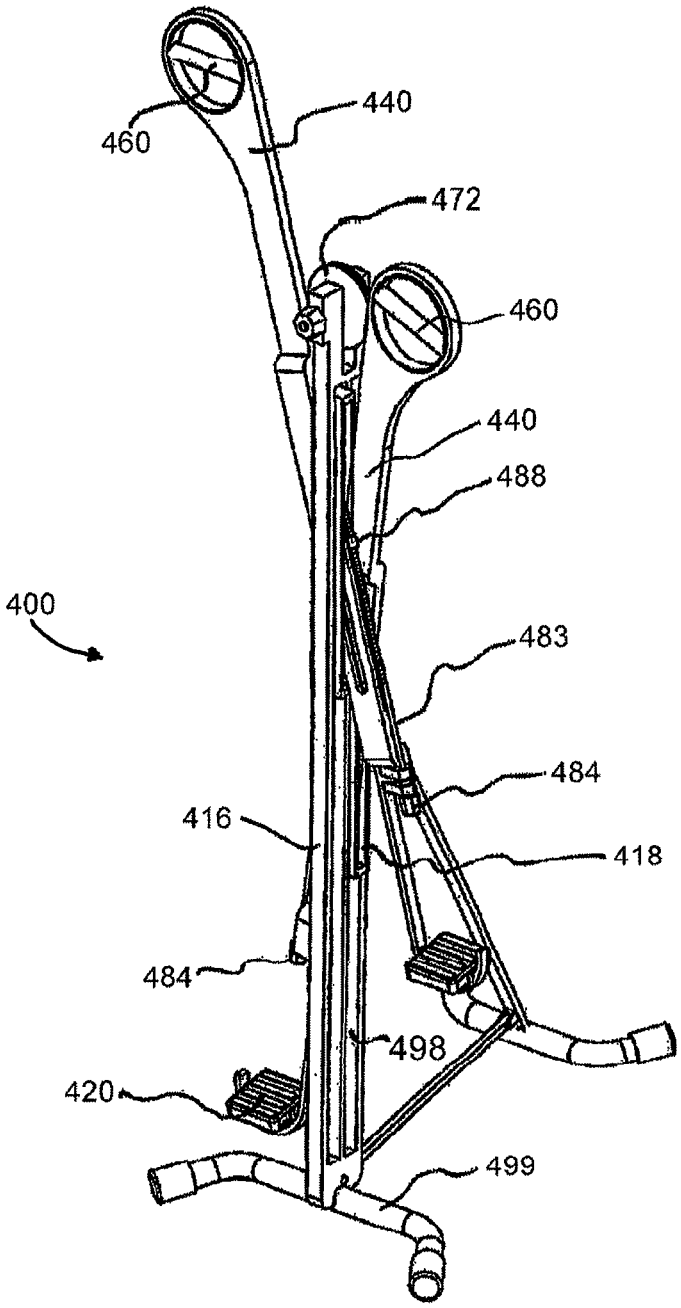
FIG. 13 is a perspective view of a fourth embodiment of a climbing exercise apparatus.
Figure 14:
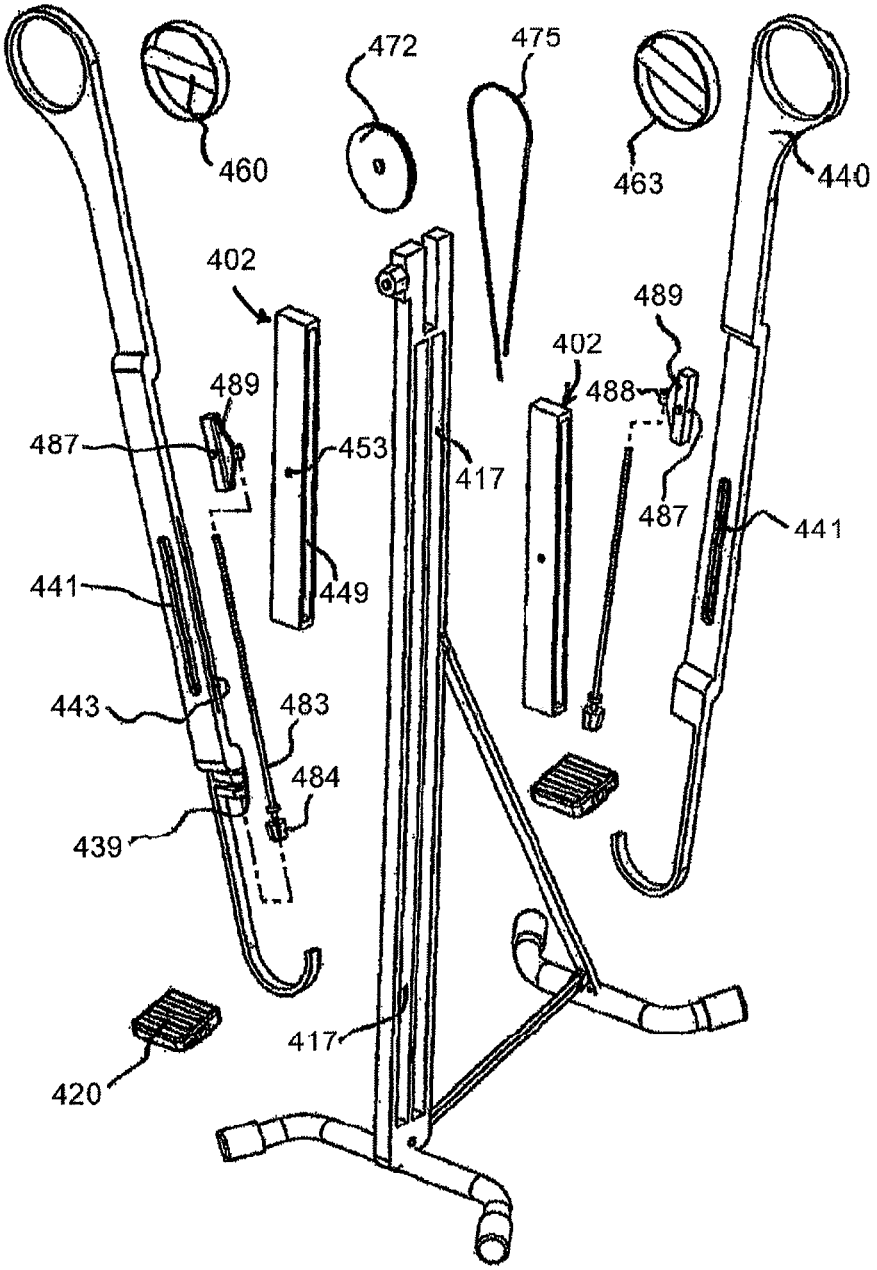
FIG. 14 is an exploded perspective view of the climbing exercise apparatus shown in FIG. 13.
Figure 15:
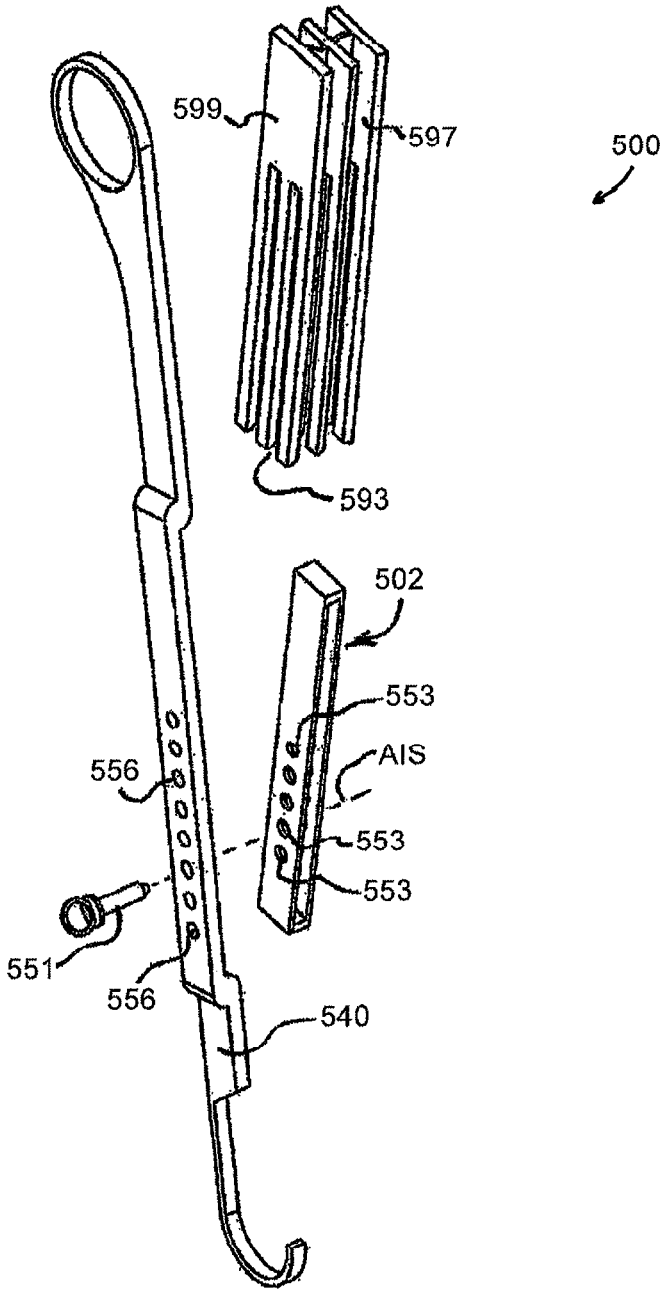
FIG. 15 is an exploded perspective of a fifth embodiment of a climbing exercise apparatus.

Referring now to FIG. 13-15, fourth and fifth embodiments of a climbing exercise apparatus are generally identified by the reference numerals 400 and 500, respectively. As noted by the common use of reference numerals, the climbing exercise apparatus 400 and 500 are similar to the climbing exercise apparatus 300, however, in climbing exercise apparatus 400 and 500, the ratio of lateral movement between the hand grips 460 motion as compared to the foot pedals 342 motion may be adjusted. Right and left pivot blocks 402 are linearly constrained to move along races 417 of the stanchion 416. Foot pedals 420 may be connected to a lower distal end of longitudinal members 440, and hand grips 460 may be connected to an upper distal end of longitudinal members 440. Pulley 472 may be rotatably secured to the stanchion 416, and a cable 475 may be routed over the pulley 472. Opposite distal ends of the cable 475 are secured to anchors rigidly secured to each of the longitudinal members 440. Each longitudinal member 440 may include a generally centrally located side slot 441 and an edge slot 443 along a longitudinal edge 445. The side slots 441 extend through the longitudinal members 440 forming an opening in the longitudinal direction. The edge slots 443 extend along one edge 443 of the longitudinal members 440 and intersect a respective side slot 441. Slave slide blocks 489 may be received in the side slots 441 of the longitudinal members 440. The slave slide blocks 489 may include pins 487 projecting in opposite directions from the body of the slave slide block 489. The pins 487 may extend through the side slots 441 of the longitudinal members 440 into holes 453 formed in the opposite sides of the pivot blocks 402, thereby rotatably securing the longitudinal members 440 to the pivot blocks 402.

Slave slide blocks 489 may further include a boss 488 projecting through the edge slots 443 of the longitudinal members 440. The bosses 488 may include an internally threaded borehole. A lead screw 483 may be rotatably secured proximate a lower distal end of the longitudinal members 440. The opposite end of the lead screw 483 may be threadedly connected to the bosses 488 of the slave slide blocks 489 in a manner such that rotation of the lead screw knob 484, moves the slave slide blocks 489 and pivot blocks 402 in a longitudinal direction relative to the longitudinal members 440. Rotation of the lead screw knob 484 moves pivot block 402 along a respective frame race 417 to adjust the operational range of the pivot blocks 402. The frame race races 417 are of sufficient length to accommodate different operational ranges of the pivot blocks 402 for adjusting the lateral distance ratio between the user's hands and feet. For example, during relatively wide lateral movement of the foot pedals 420 as compared to the lateral movement of the hand grips 460, the slide blocks 402 may generally reciprocate throughout an elevated range within the frame races 417, and during relatively narrow lateral movement of the foot pedals 420 as compared to the lateral movement of the hand grips 460 movement, the slide blocks 402 may generally reciprocate throughout a relatively low range within the frame races 417.

Referring now to FIG. 15, only one longitudinal member 540 and one pivot block 502 with a partial perspective view of the stanchion 506 of the climbing exercise apparatus 500 are shown for purposes of convenience. It is understood that the climbing exercise apparatus 500 is similar to the climbing exercise apparatus 400 and includes all the structural components required to operate properly. The lateral motion ratio between the user's feet and arms of the climbing exercise apparatus 500 may be manually adjusted. The pivot block 502 may include at least one hole 553 (multiple holes 553 are shown in the event of limited frame race length) to receive the pin 551. The longitudinal member 540 may include a plurality of holes 556. Pivot blocks 502 may be displaced both side by side and front to back in the side slots 597 of the stanchion 516. The side slots 597 define longitudinal channels through which longitudinal member 540 and pivot block 502, may reciprocate. The stanchion 516 may also include front and back slots 593 through which the head of pin 551 passes in a movable manner during operation of the climbing exercise apparatus 500. For any given adjustment of the lateral motion ratio of the exercise apparatus 500, the axis A of the pin 551 is coincident with a given pair of holes 556 and 553 aligned with one another.

While preferred embodiments of a climbing exercise apparatus have been shown and described herein, other and further embodiments may be devised without departing from the basic scope thereof, and the scope thereof is determined by the claims which follow.

The invention claimed is:

1. A climbing exercise apparatus, comprising:

a) a frame including a base and a stanchion extending generally vertically upward from said base;

b) a bracket fixedly secured to said stanchion;

c) a first pivot block and a second pivot block pivotally connected to said bracket;

d) a first longitudinal member and a second longitudinal member movably supported by a respective said first pivot block and said second pivot block;

e) said first longitudinal member and said second longitudinal member angularly oriented relative to a longitudinal axis of said stanchion; and f) a foot support member coupled proximate a lower distal end of each said first longitudinal member and said second longitudinal member.

2. The climbing exercise apparatus of claim 1 wherein said first pivot block and said second pivot block include sector gears cooperatively engaged for oppositional pivoting of said first pivot block and said second pivot block.

3. The climbing exercise apparatus of claim 1 wherein said first pivot block and said second pivot block each include a pair of longitudinal races extending generally vertically in spaced, parallel alignment with one another.

4. The climbing exercise apparatus of claim 3 wherein said first longitudinal member and said second longitudinal member each include a pair of longitudinal shafts, wherein said pair of longitudinal shafts are slidably received in a respective said pair of longitudinal races in such a manner that said first longitudinal member and said second longitudinal member are linearly constrained to move generally vertically.

5. The climbing exercise apparatus of claim 1 including arm members adjustably secured to said first longitudinal member and said second longitudinal member.

6. The climbing exercise apparatus of claim 1 wherein movement of said first longitudinal member and said second longitudinal member includes a vertical component and a lateral component.

7. A climbing exercise apparatus, comprising:

a) a frame including a base and a stanchion extending generally vertically upward from said base;

b) a pair of longitudinal members movably supported by said stanchion;

c) said pair of longitudinal members angularly oriented relative to a longitudinal axis of said stanchion, wherein said pair of longitudinal members are configured to move relative to said stanchion in a motion including a vertical component and a lateral component; and d) a foot support member coupled proximate a lower distal end of each said pair of longitudinal members.

8. The climbing exercise apparatus of claim 7 including a pair of pivot blocks pivotally secured to said stanchion, wherein said pair of longitudinal members include a lower portion defining a channel adapted to slidably receive a respective said pair of pivot blocks.

9. The climbing exercise apparatus of claim 7 wherein lateral movement of said pair of longitudinal members is independent from one another responsive to force applied by a user.

10. The climbing exercise apparatus of claim 7 wherein said stanchion includes a pair of longitudinal slots aligned front to back extending generally vertically, and further including a pair of pivot blocks linearly constrained to move along a respective said pair of longitudinal slots of said stanchion.

11. The climbing exercise apparatus of claim 10 wherein said pair of longitudinal members are pivotally secured to a respective said pair of pivot blocks.

12. The climbing exercise apparatus of claim 8 wherein said pair of longitudinal members include a side slot forming an opening in the longitudinal direction of said pair of longitudinal members, and further including an edge slot intersecting a respective said side slot.

13. The climbing exercise apparatus of claim 12 including a slave slide block received in a respective said side slot of said pair of longitudinal members, said slave block including pins projecting outwardly in opposite directions extending into said side slot of said pair of longitudinal members pivotally connecting said pair of longitudinal members to a respective said pair of pivot blocks.

14. The climbing exercise apparatus of claim 7 including a lead screw rotatably secured proximate a lower distal end of a respective said pair of longitudinal members, and further includes a pair of pivot blocks linearly constrained to move along a respective said pair of longitudinal slots of said stanchion, wherein rotation of said lead screw moves said pivot blocks in a longitudinal direction relative to said pair of longitudinal members.

15. A climbing exercise apparatus, comprising:

a) a frame including a base and a stanchion extending generally vertically upward from said base;

b) left and right longitudinal members movably supported by said stanchion, wherein said left and right longitudinal members are configured to move relative to said stanchion in a motion including a vertical component and a lateral component;

c) said left and right longitudinal members angularly oriented relative to a longitudinal axis of said stanchion;

d) a foot support member coupled proximate to a lower distal end of each said left and right longitudinal members, and e) said left and right longitudinal members including a hand grip proximate to an upper distal of each said left and right longitudinal members.

* * * * *